US005465957A

United States Patent [19]

Schroeder

[11] Patent Number: 5,465,957

[45] Date of Patent: Nov. 14, 1995

[54] RETAINER FOR ADJUSTABLE BASKETBALL BACKBOARDS

[75] Inventor: Edward A. Schroeder, Marengo, Ill.

[73] Assignee: Porter Athletic Equipment Company, Broadview, Ill.

[21] Appl. No.: 181,436

[22] Filed: Jan. 14, 1994

Related U.S. Application Data

[63] Continuation-in-part of Ser. No. 921,645, Jul. 30, 1992.

[51] Int. Cl.[6] ..... A63B 71/02

[52] U.S. Cl. ..... 273/1.5 R; 248/286.1

[58] Field of Search ..... 273/1.5 R, 1.5 A; 248/280.1, 292.1, 281.1, 286, 291, 284

[56] References Cited

U.S. PATENT DOCUMENTS

| | | | |
|---|---|---|---|
| 278,797 | 6/1983 | Ide | 248/292.1 |
| 3,414,262 | 12/1968 | Lounsbury | 273/1.5 R |
| 3,891,173 | 6/1975 | Ellis et al. | 248/286 X |
| 4,480,142 | 1/1989 | Friesen | 273/1.5 R |
| 4,522,211 | 5/1891 | Cardarelli | 248/292.1 |
| 4,781,375 | 11/1988 | Nye | 273/1.5 R |
| 4,941,661 | 7/1990 | Lykens | 273/1.5 R |
| 5,316,290 | 5/1994 | Parr et al. | 273/1.5 R |

FOREIGN PATENT DOCUMENTS

| | | | |
|---|---|---|---|
| 286216 | 2/1965 | Netherlands | 273/1.5 R |
| 908055 | 10/1962 | United Kingdom | 273/1.5 R |
| 1152846 | 5/1969 | United Kingdom | 273/1.5 R |

OTHER PUBLICATIONS

Exhibit A, Mar. 1989 (Photos of device in public use).

*Primary Examiner*—Paul E. Shapiro
*Attorney, Agent, or Firm*—Barnes & Thornburg

[57] ABSTRACT

An adjustable height basketball backboard support system wherein a retainer is attached to an adjustment link in order to maintain the adjustment link adjacent to the support member during the adjustment process. The retainer consists of a slide which rides on a guide or rail. The slide includes two parallel legs, although one leg can be used, which extend to and form an U-shaped terminal end. The slide can also consist of a loop configuration. The guide or rail is positioned on the support member or can even be the support member. The slide's legs curve around the guide which can be a bracket attached to the support member or the support member itself. The retainer can be both the retaining mechanism and the mechanism which locks the adjustment link to the support member or it can be a separate element which only serves as the retaining mechanism. The interaction between the retainer and the bracket or support member prevents the adjustment link from swinging away from the support member during the adjustment process.

9 Claims, 4 Drawing Sheets

RETAINER FOR ADJUSTABLE BASKETBALL BACKBOARDS

CROSS REFERENCE

This is a continuation-in-part of Ser. No. 07/921,645, filed Jul. 30, 1992.

BACKGROUND AND SUMMARY OF THE INVENTION

The invention relates to an improvement of an adjustable height basketball backboard support system through the disclosure of a unique and novel retainer which prevents an adjustment link from swinging away from the support member during the adjustment process. One form of an adjustable basketball backboard support system includes a basketball backboard which is mounted to a support member through a parallelogram linkage and wherein a counterweight is utilized to allow for easy adjustment of the height of the basketball backboard. The adjustment mechanism includes an adjustment link which adjustably connects one of the parallelogram links to the support member to determine the height of the basketball backboard. A pin secures the adjustment link to the support member at the desired height.

In addition, the adjustable basketball backboard support system can include a handle which is placed on the adjustment link. This handle facilitates the holding of the basketball backboard while its height is adjusted. Moreover, the handle provides an additional safety feature to the basketball backboard support system. Specifically, the handle protects the user's hand during the adjustment process by permitting the user to grasp the adjustment link on the side of the adjustment link farthest from the support member. Prior art systems do not generally include this feature and require the user to grasp the bottom of the adjustment link or the side of the adjustment link closest to the support member. Therefore, a feature of this handle is that it prevents the adjustment link from striking the user's hand. Users of prior art systems also find it difficult to laterally align the adjustment link with the support member.

Because the adjustment link is pivotally connected to the parallelogram, it will swing away from the support member when the user adjusts the height of the backboard. This is a significant problem in the adjustable basketball backboard support system field because some of the force applied during the adjustment process is converted to angular motion which makes the alignment of the holes in the adjustment link and the support member more difficult. In addition, the problem of the adjustment link swinging away from the support member can also create an unsafe situation. For instance, the angular motion could cause the adjustment link to strike the user.

Therefore, it is an object of the present invention to limit the angular motion of the adjustment link during the adjustment process.

Another object of the present invention is to assist the user in the alignment of the adjustment link with the support member during the adjustment process.

A further object of this invention is to ensure the safety of the user during the adjustment process.

A further object of this invention is to eliminate the difficulty a user encounters in trying to laterally align the adjustment link and support member.

These and other objects are achieved by modifying and improving the basic adjustable height basketball backboard support system by adding a retainer to maintain the adjustment link adjacent to the support member during the adjustment process. This inventive retainer can be generally described as consisting of a slide which rides on a guide or a rail. As will subsequently be discussed in greater detail, the guide or rail is positioned on the support member. In fact, the guide or rail can even be the support member. However, the guide or rail will generally be a bracket. In this type of configuration, the slide's legs will curve around the guide or bracket and limit the amount of rotation of the adjustment link by interacting with the bracket if the adjustment link begins to rotate away from the support member. The slide should have at least two legs to ensure the stability of the retainer, but one leg could be used. Hence, the retainer is positioned at the side of the adjustment link adjacent to the support member and is configured in such a way that it prevents the adjustment link from swinging away from the support member during the adjustment process.

The retainer can be made from a variety of materials such as plastic or aluminum. The retainer can also take on a variety of configurations. For example, in the preferred embodiment, the retainer consists of a slide attached to the side of the adjustment link closest to the support member. The slide consists of two parallel legs which extend to a U-shaped terminal end. In this embodiment, the guide is attached to the support member. The U-shaped configuration permits the slide to ride on the guide which consists of a bracket which is mounted to the support member by a pair of C-clamps.

This configuration achieves the objective of preventing the adjustment link from swinging away from the support member during adjustment. This is accomplished by the fact that the slide curves around the guide, bracket. As the adjustment link swings away from the support member, the U-shaped terminal ends contact the bracket which prevents any further angular motion of the adjustment link. In this embodiment, the handle and the retainer are separate units secured to the adjustment link by different bolts.

An alternative embodiment may include the feature of combining the handle and retainer into one unit. This configuration would consist of a slide made up of two parallel leg extensions of a handle that extend to and form two U-shaped terminal ends. This configuration would also consist of a guide that is attached to the support member. The retainer would still be configured so that the U-shaped terminal ends would contact or engage the guide during the adjustment process thereby preventing additional angular motion of the adjustment link. A feature of this embodiment is that the handle and retainer are combined into one piece which will reduce the amount of time required to manufacture the invention as well as reduce the cost of manufacturing.

This invention also contemplates a configuration whereby the slide is configured as a loop which curves around the support member. Specifically, the loop can consist of two parallel legs which extend to and join to form a single U-shaped terminal end. However, in order to maintain the loop configuration, the U-shaped terminal end should have more curvature than the U-shaped terminal ends in the preferred embodiment due to the fact that in this embodiment, the support member serves as the guide while a bracket served as the guide in the first embodiment. The slide loop may be secured to the adjustment link and support member by a bolt and simultaneously lock the height adjustment. It should be noted that in the loop configuration, the slide can be both the retaining mechanism and the mechanism which locks the adjustment link to the support member or it can be a separate element which only serves as the retaining mechanism. In the configuration where the slide only serves as the retaining mechanism, a bracket attached at the end of the adjustment link can be used to lock the adjustment link to the support member.

These retainer configurations ensure that the adjustment link will not swing away from the support member during the height adjustment process. Furthermore, these configurations ensure that the adjustable basketball backboard support system is easy-to-use and safe.

Other objects, advantages and novel features of the present invention will become apparent from the following detailed description of the invention when considered in conjunction with the accompanying drawings.

DETAILED DESCRIPTION OF THE INVENTION

Referring to the figures, the inventive retainer is identified generally by numeral 43. This invention improves the basic adjustable basketball backboard support system by including a retaining means for preventing the adjustment link from swinging away from the support member during the adjustment process. The basic adjustable basketball backboard support system must first be described in order to fully understand the integral elements of retainer 43 and how retainer 43 operates during the adjustment process.

Figure 1:
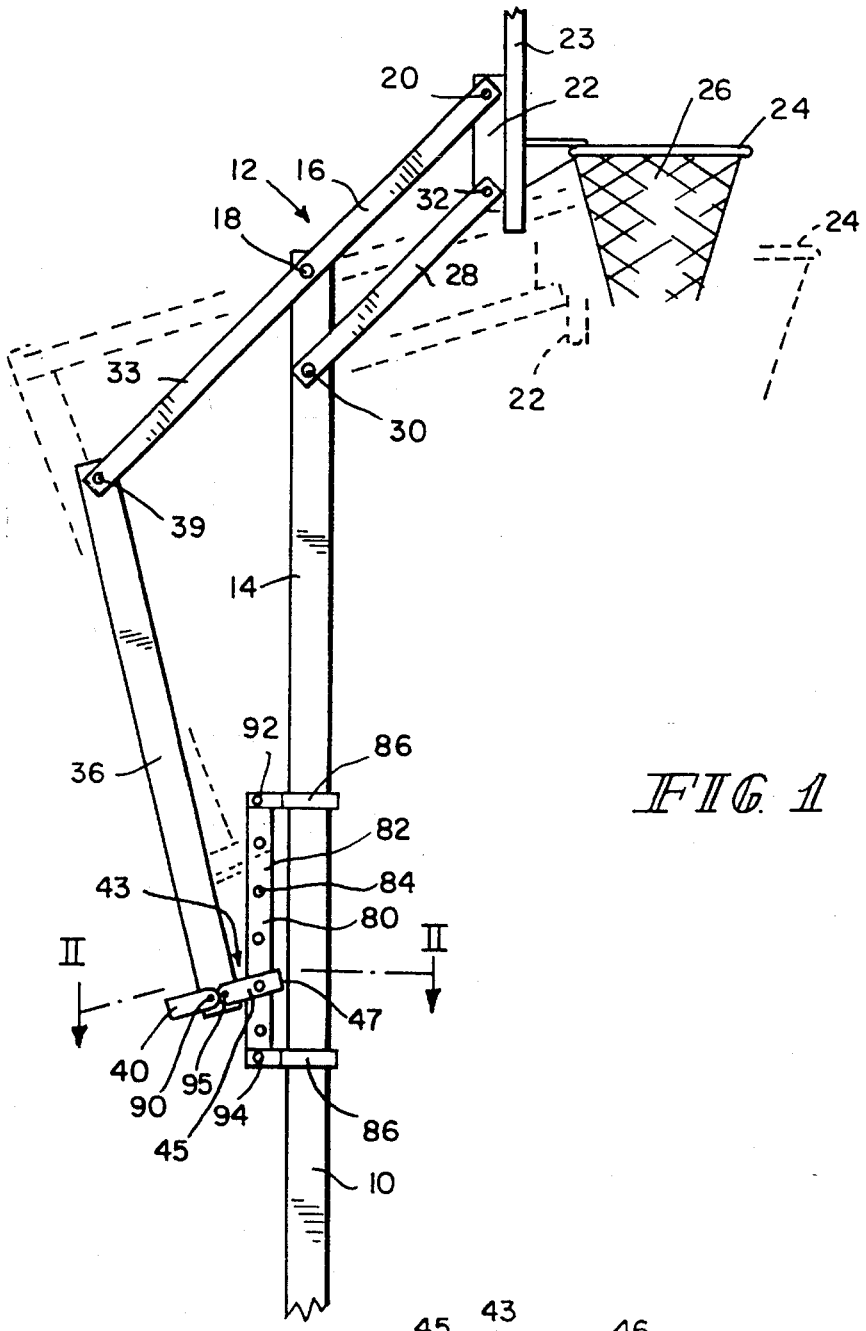
FIG. 1 shows a side view of the adjustable basketball backboard parallel linkage including a first embodiment of a retainer according to the principles of the present invention.

FIG. 1 shows a basketball support member 10 which can be mounted by sinking its lower end into the earth or a concrete footing. Alternatively, the support member can be mounted on a portable mobile support platform (not shown) as is used in indoor basketball arenas, playgrounds or driveways. The support member 10 can be a round steel column, hollow post, I-beam or other structure which can rigidly support a basketball backboard.

The support member has a four bar parallelogram linkage system 12 attached thereto at its upper end 14. The parallelogram linkage system 12 includes two upper links 16 (only one of which can be seen in FIG. 1 as the second extends parallel and at the same angle on the other side of the support member 10 and thus is hidden from view). The upper links 16 are attached to the upper end 14 of the support member 10 by a pivot rod or bolt 18 extending through the support member 10 and rotatably securing the upper links 16 to opposite sides of the support member 10.

Outer ends of the upper links 16 are pivotally attached to a basketball backboard bracket 22 by pivot rods on bolts 20. A backboard 23, which has attached thereto a basketball rim 24 and net 26, is mounted to bracket 22. The rim 24 may be mounted to the backboard or directly to the bracket 22. A pair of lower links 28 (only one of which can be seen in FIG. 1) are also provided and attached by pivot structures 30, 32 to two sides of the support member 10 and basketball backboard bracket 22, respectively. Plural upper links 16 and lower links 28 are utilized, one on each side of the support member 10, to keep the backboard 23 from canting with respect to the support member 10. While two upper links 16 and two lower links 28 provide a good anti-canting support for the backboard 23, only one upper or lower link 16,28 is necessary and a three link system is also contemplated utilizing a single upper link 16 with two lower links 28 or two upper links 16 and one lower link 28. Even a single lower and upper bar linkage is possible.

Figure 3:
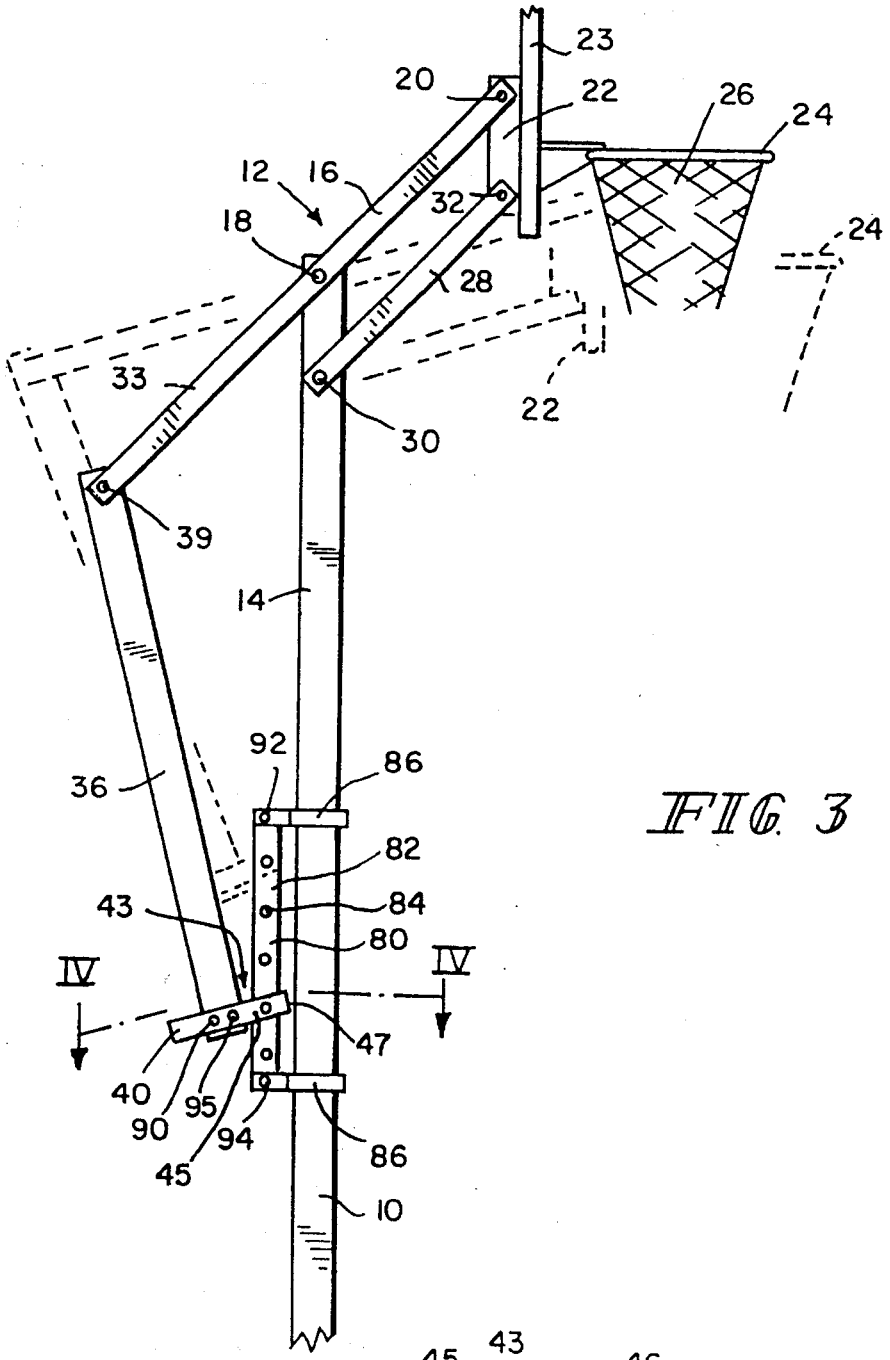
FIG. 3 shows a side view of a second embodiment of the retainer wherein the retainer and the handle are one unit.
Figure 5:
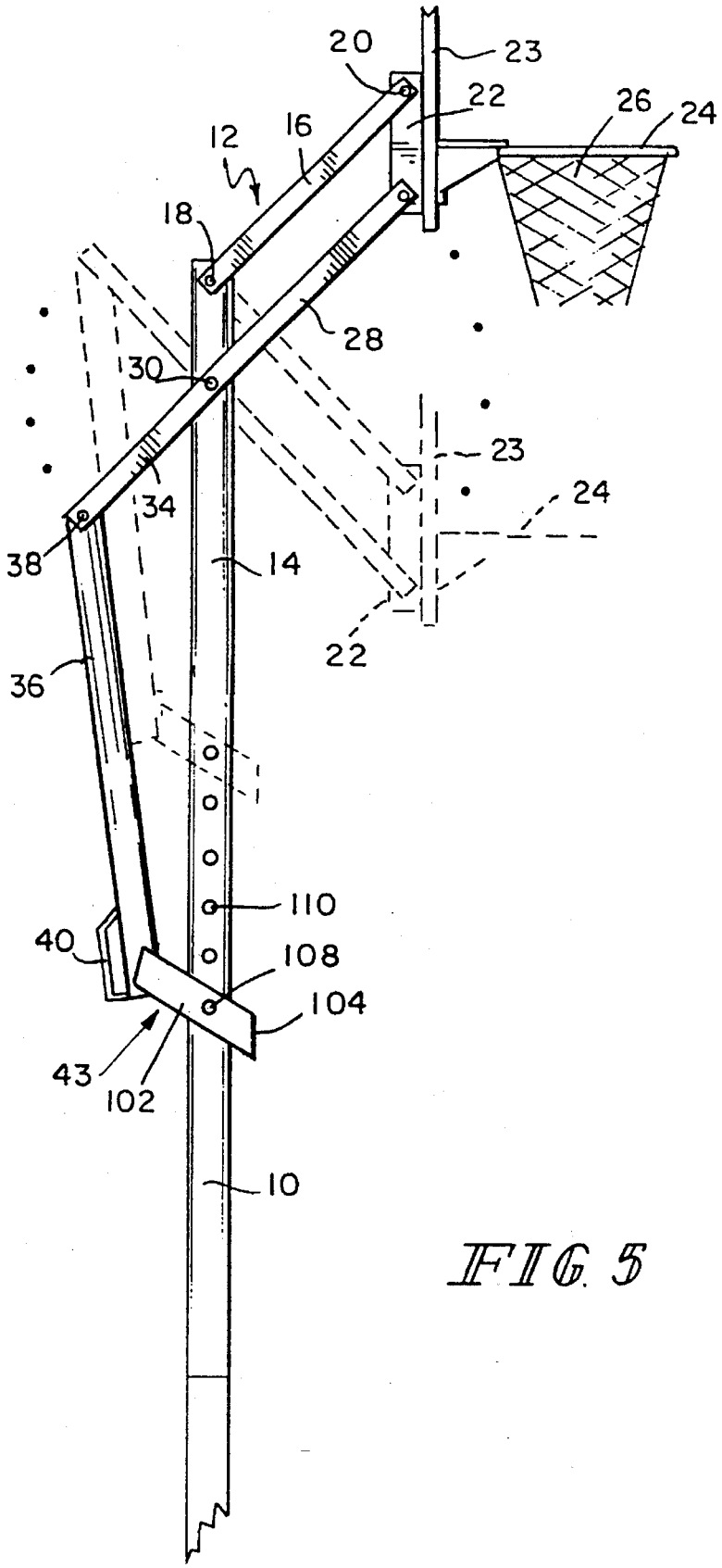
FIG. 5 shows a side view of a third embodiment of the retainer wherein a loop retainer functions as a locking mechanism and retaining mechanism.

At least one and preferably both links of one of the pair of links has an extension portion thereon that extends past the pivot to an opposite side of the support member 10 from the basketball backboard 23. As illustrated in FIGS. 1 and 3, the upper link or links 16 have an extension portion 33 while in FIGS. 5 and 6, the lower link or links 28 includes an extension 34. Attached to extension 33 by a pivot 39 in FIG. 1 and a pivot 38 in FIG. 5 is an adjustment link 36 which also serves as a counterweight.

Figure 6:
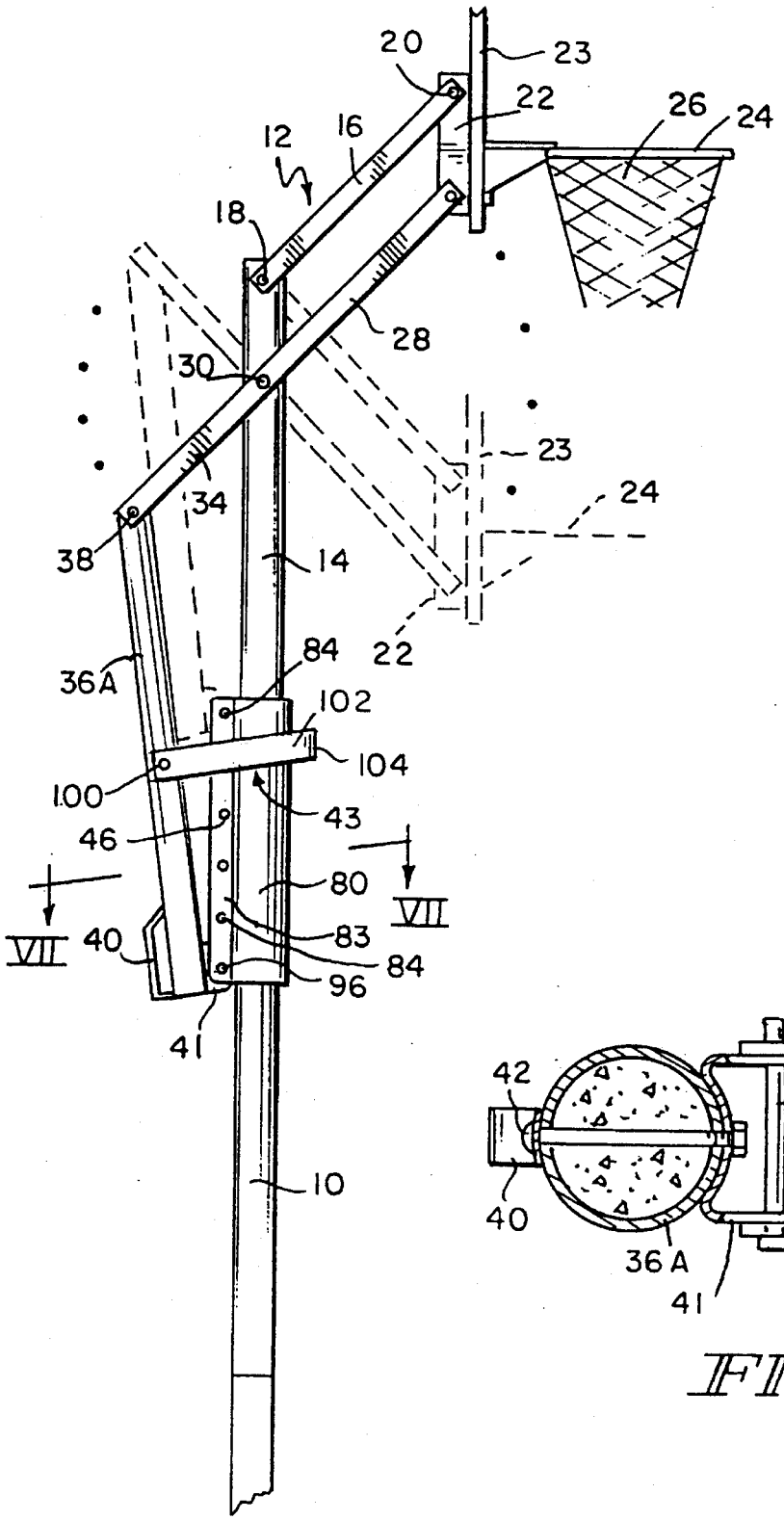
FIG. 6 shows a modification of the retainer of FIG. 5 wherein a loop retainer serves only as the retaining mechanism.
Figure 7:
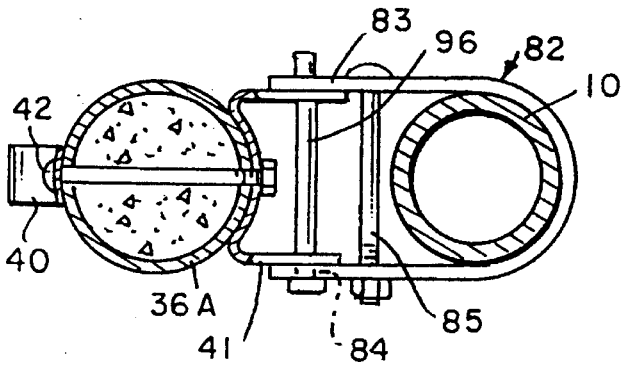
FIG. 7 shows a cross-sectional view of an anchor taken along line VII—VII of FIG. 6.

This counter-weight link 36 can be a solid heavy bar 36 (FIG. 1) or a hollow tube 36A filled with ballast as shown in FIG. 7. The counter-weight link 36 is of such weight as to provide a force tending to rotate upper link 16 counterclockwise to counter the weight of the backboard 23 which tends to rotate the upper link 16 clockwise in the drawing. The purpose of the counter-weight concept is to make adjustment of the height of the backboard 23 easier. Where a hollow tube 36A filed with ballast is utilized (FIGS. 6 and 7), it may be desirable to have the tube longer in length and/or wider in cross-section than the solid rod in order to compensate for the ballast weighing less than a solid rod. One way to lengthen the link 36 is to attach the link 36 to an extension 33 on one or more of the upper links 16 as shown in FIG. 1. The hollow tube 36A of FIG. 6 is closed at its bottom end and may be opened at its top end to receive the ballast. The ballast may include cement, sand or a liquid such as water or other available material. The amount of ballast is determined by and adjusted to the weight of the backboard 23 and the parallelogram linkage system 12.

FIG. 1 also shows a handle 40 positioned on the adjustment link 36 at the side farthest from the support member 10. The handle 40 is attached to adjustment link 36 by bolt 90. The handle 40 could also be welded to adjustment link 36. The handle 40 helps the user hold the basketball backboard 23 while its height is adjusted. The positioning of the handle 40 on the adjustment link 36 protects the user's hand during the height adjustment process.

The inventive features of retainer 43 will now be discussed with the basic features of the above adjustable basketball backboard system kept in mind. While the retainer 43 can take on a variety of configurations, in the preferred embodiment, retainer 43 is positioned at the side of the adjustment link 36 closest to the support member 10.

Figure 2:
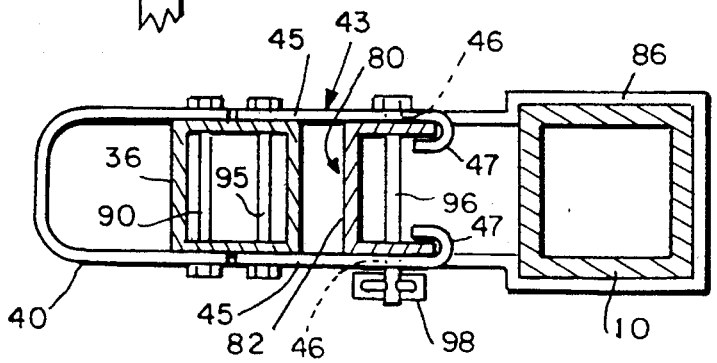
FIG. 2 shows a cross-sectional view of the retainer taken along line II—II of FIG. 1.

In FIGS. 1 and 2, the retainer 43 includes two parallel legs 45. Each leg 45 extends to and forms an U-shaped terminal end 47. The U-shaped terminal end 47 permits the legs 45 to ride on a guide or rail 80, which will be referred to as an anchor. The anchor 80 has a bracket 82 which includes a plurality of height adjustment holes 84. Anchor 80 is mounted to the support member 10 by a pair of C-clamps 86. Bolts 92 and 94 secure C-clamps 86 to anchor 80. While two legs 45 add stability to retainer 43, one leg could be used in this embodiment or the other embodiments discussed herein.

FIGS. 1 and 2 also show retainer 43 being secured to the adjustment link 36 by bolt 95. Each leg 45 has a hole 46 which receives a pin 96 in order to secure the retainer 43 and adjustment link 36 to the support member 10 by one of the holes 84 in anchor 80. FIG. 2 also shows a padlock 98 connected to one end of pin 96 which locks the retainer 43 to the anchor 80 and thereby helps prevent any possible theft of the assembly.

The retainer 43 operates in the following manner. To begin with, when the user decides to adjust the height of the basketball backboard 23, he/she first removes lock 98 from pin 96. The user then removes pin 96 which secures the adjustment link 36 to the support member 10 and either raises or lowers the height of the backboard 23 by grabbing the handle 40 which begins the adjustment process. The handle 40 allows the adjustment link to be held and moved upward and downward with one hand while a second hand positions pin 96 through a pair of holes 46 on legs 45 and a selected pair of height adjustment holes 84 on anchor 80 to provide the desired height of the basketball backboard 23. This configuration prevents the adjustment link 36 from striking the user's hand and thereby provides an additional safety feature to this system.

As discussed previously, because adjustment link 36 is pivotally connected to the parallelogram, the adjustment link 36 will swing away from the support member 10 when the user adjusts the height of the backboard 23 in the above manner.

FIG. 2 shows how the retainer 43 interacts with anchor 80 to solve the problem of the adjustment link 36 swinging away from support member 10 during the adjustment process. Specifically, retainer 43 curves around anchor 80 in order to prevent the adjustment link 36 from swinging away from the support member 10 when pin 96 and padlock 98 are removed from the system during the adjustment process. In this embodiment, retainer 43 has two parallel legs 45 which extend to and form two terminal ends 47 having a U-shaped configuration that curves around bracket 82 of anchor 80. There is enough space between the terminal ends 47 and bracket 82 to allow the user to freely move adjustment link 36 vertically to the desired height. However, if during the adjustment process the adjustment link 36 begins to rotate away from the support member 10, the U-shaped terminal ends 47 will contact bracket 82 and prevent the adjustment link 36 from rotating away from the support member 10.

Figure 4:
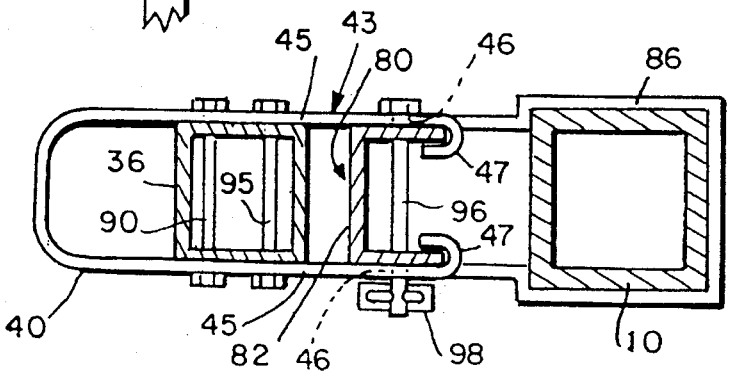
FIG. 4 shows a cross-sectional view of the retainer and handle taken along line IV—IV of FIG. 3.

FIGS. 3 and 4 show a second configuration of retainer 43. In this configuration, retainer 43 and handle 40 are combined into one unit. In other words, retainer 43 is simply an extension of handle 40 and bolts 90 and 95 are used to secure the combined handle 40 and retainer 43 to adjustment link 36. Hence, retainer 43 is not independent of handle 40. The retainer 43, as an extension of handle 40, has two parallel legs 45 which extend to and form two U-shaped terminal ends 47 which curve around bracket 82 of anchor 80. If the adjustment link 36 begins to rotate away from support member 10, the U-shaped terminal ends 47 will contact bracket 82 and will limit the amount of rotation of adjustment link 36. This configuration—the retainer 43 being an extension of handle 40—will reduce the amount of time required to manufacture the system as well as reduce the cost of manufacturing.

FIG. 5 shows another configuration for retainer 43. In this embodiment, retainer 43 is attached to the side of the adjustment link 36 closest to the support member 10. In this configuration, retainer 43 has a loop configuration with two parallel legs 102 (only one of which can be seen in FIG. 5) which join and form a single U-shaped terminal end 104 on the opposite side of support member 10. In this configuration, retainer 43 serves as both the retaining mechanism and the mechanism which locks the adjustment link 36 to the support member 10.

In terms of the locking mechanism, both legs 102 have a hole (not shown in FIG. 5) for receiving a pin 108 which is inserted through such hole to provide for the securement of adjustment link 36 to support member 10. The support member 10 has a plurality of height adjustment holes 110. When the desired height is determined, pin 108 is inserted through the hole of each leg 102 as well as the corresponding height adjustment holes 110. Pin 108 secures both the retainer 43 and the adjustment link 36 to the support member 10.

In terms of the retaining mechanism, retainer 43 operates in the following manner. Legs 102 extend from the adjustment link 36 to the U-shaped terminal end 104 which curves around the support member 10. During the adjustment process, the user removes pin 108 in order to raise or lower backboard 23. Because the adjustment link 36 is pivotally connected to the parallelogram it will rotate away from the support member 10 during this adjustment process. When the adjustment link 36 begins to swing away from support member 10, the U-shaped terminal end 104 will contact the support member 10 and limit any additional rotation of adjustment link 36. This loop configuration is an effective retaining mechanism because the U-shaped terminal end remains on the side of the support member 10 farthest from the adjustment link 36.

FIG. 5 also shows a handle 40. Handle 40 allows the adjustment link 36 to be held and moved upward and downward with one hand while a second hand positions pin 108 through a pair of holes on retainer 43 and a selected pair of holes 110 on the support member 10. It should be noted that retainer 43 is independent of handle 40 in this configuration.

FIGS. 6 and 7 show another configuration whereby retainer 43 is simply a looped shaped retaining mechanism and does not serve as the locking mechanism for adjustment link 36 to the support member 10. In this embodiment, the handle 40 and a bracket 41 am attached to adjustment link 36 by bolt 42 (see FIG. 7). Attached to the support member 10 is the anchor 80 which consists of C-clamp bracket 82. This bracket 82 can be welded, bolted 85 or otherwise fixed to the support member 10 and is provided with extending lips 83 that have a plurality of height adjustment holes 84. The bracket 41 at the end of the adjustment link 36 is attached to at least one of these holes 84 in lip 83 by a pin 96 to determine the height of the basketball backboard 23.

Retainer 43 is the same loop configuration as described above in FIG. 5 except in this configuration the retainer 43 only operates as a retainer limiting the rotation of the adjustment link 36 while the locking mechanism is performed by the connection of bracket 41 to one of the holes 84 in lip 83. Retainer 43 is attached to the side of the adjustment link 36 closest to the support member 10 by a pivot rod or bolt 100.

It is important to note that the retainer 43 shown in the above configurations can be used with a two, three, or four link system.

This invention solves the problems of the prior art references in that it provides a retaining means for maintaining the adjustment means adjacent to the support member during the height adjustment process.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An adjustable basketball backboard support system comprising:

basketball backboard;

a support member;

a parallelogram linkage system including at least two parallel links pivotally interconnecting the basketball backboard and the support member;

an adjustment link connected at one end to one of said links and adjustably connected at the other end to the support member to determine the height of the basketball backboard;

a slide on the adjustment link and a guide on the support member upon which said slide moves; and a handle connected to and forming a unit with said slide and being adjacent to the side of the adjustment link farthest from the support member.

2. An adjustable basketball backboard support system comprising:

basketball backboard;

a support member;

a parallelogram linkage system including at least two parallel link pivotally interconnecting the basketball backboard and the support member;

an adjustment link connected at one end to one of said links and adjustably connected at the other end to the support member to determine the height of the basketball backboard;

a guide mounted on and displaced from the support member rearwardly thereof and on a line between said support member and said adjustment link; and a slide on the adjustment link and having at least one leg having an end transverse to said adjustment link and terminating in the space between the guide and the support member, said end engaging and sliding on said guide.

3. The system according to claim 2 wherein said slide and said guide loosely engage for limited amounts of lateral motion between the adjustment link and the support member during adjustment.

4. The system of claim 2 wherein:

said guide is an anchor mounted to said support member and said guide has a plurality of holes defining a plurality of heights of said backboard;

said slide includes a hole; and a pin adjustably secures said slide to said anchor through one of said holes.

5. The system of claim 4 wherein said anchor includes a C-clamp for mounting said anchor to said support member.

6. The system of claim 2 wherein said adjustment means includes a handle adjacent to the side of the adjustment link farthest from the support member for facilitating holding of the basketball backboard while adjusting the height of said backboard.

7. An adjustable basketball backboard support system comprising:

basketball backboard;

a support member;

a parallelogram linkage system including at least two parallel link pivotally interconnecting the basketball backboard and the support member;

an adjustment link connected at one end to one of said links and at a point of connection adjustably connected at the other end to the support member to determine the height of the basketball backboard; and a loop attached to the adjustment link at a location vertically displaced from the point of connection of the adjustment link to the support member and loosely wrapped around the support member for limiting the amounts of lateral motion between the adjustment link and the support member during adjustment.

8. The system of claim 7:

wherein said adjustment link includes a locking bracket which is attached to the side closest to said support member and said bracket includes a hole; and including an anchor mounted to said support member and having a plurality of holes defining a plurality of heights of said backboard; and a pin adjustably secures said bracket to said anchor through one of said holes.

9. The system of claim 7, wherein said adjustment means includes a handle adjacent to said other end of the adjustment link for facilitating holding of the basketball backboard while adjusting the height of said backboard.

* * * * *